US009481533B2

(12) United States Patent
Hwang et al.

(10) Patent No.: US 9,481,533 B2
(45) Date of Patent: Nov. 1, 2016

(54) MEDIUM SEPARATION DEVICE OF ATM

(71) Applicant: Nautilus Hyosung Inc., Seoul (KR)

(72) Inventors: Jin Young Hwang, Seoul (KR); Jong Seong Park, Anyang-si (KR); Chang Ho Park, Gunpo-si (KR); Young Chul Lee, Anyang-si (KR)

(73) Assignee: NAUTILUS HYOSUNG INC., Seoul (KR)

( * ) Notice: Subject to any disclaimer, the term of this patent is extended or adjusted under 35 U.S.C. 154(b) by 0 days.

(21) Appl. No.: 14/737,181

(22) Filed: Jun. 11, 2015

(65) Prior Publication Data

US 2015/0360890 A1 Dec. 17, 2015

(30) Foreign Application Priority Data

Jun. 12, 2014 (KR) ..... 10-2014-0071606

(51) Int. Cl.

*B65H 5/00* (2006.01)
*B65H 3/52* (2006.01)
*B65H 3/06* (2006.01)

(52) U.S. Cl.

CPC ..... *B65H 3/5269* (2013.01); *B65H 3/0638* (2013.01); *B65H 2404/1118* (2013.01); *B65H 2404/1141* (2013.01); *B65H 2404/255* (2013.01); *B65H 2404/262* (2013.01); *B65H 2701/1912* (2013.01)

(58) Field of Classification Search

CPC ..... B65H 2404/1141; B65H 2404/262; B65H 2701/1912
USPC ..... 271/119, 122
See application file for complete search history.

(56) References Cited

U.S. PATENT DOCUMENTS 4,025,068 A * 5/1977 Collins ..... B65H 3/5292 271/124
4,779,861 A * 10/1988 Ozawa ..... B65H 3/06 271/119
6,467,766 B2 * 10/2002 Minamishin ..... B65H 1/14 271/119
2001/0024011 A1 * 9/2001 Tamura ..... B65H 3/5261 271/10.1

* cited by examiner

*Primary Examiner* — Howard Sanders
(74) *Attorney, Agent, or Firm* — Fenwick & West LLP

(57) ABSTRACT

The invention relates to a medium separation device of an automated teller machine (ATM) that includes a pickup roller for sequentially picking up and feeding stacked media through a friction member on a portion of the outer periphery of the pickup roller, a feed roller for feeding the picked-up and fed media toward a transfer path through a friction member provided on a portion of the outer periphery of the feed roller while rotating with the same phase as the pickup roller, and a medium separation unit for separating a following medium simultaneously fed with a preceding medium fed to the feed roller while in close contact with the bottom, from the preceding medium through a separation belt, to pick up and feed media through a partial roller structure partially having a friction member and simultaneously perform the separation of the media through the medium separation unit.

8 Claims, 4 Drawing Sheets

MEDIUM SEPARATION DEVICE OF ATM

CROSS-REFERENCE TO RELATED APPLICATION

This application is based on and claims priority to Korean Patent Application No. KR10-2014-0071606 filed on Jun. 12, 2014, which is incorporated by reference herein in its entirety.

BACKGROUND OF THE INVENTION

1.Field of Invention

The present invention relates to a medium separation device of an automated teller machine (ATM), and more particularly, to a medium separation device of an ATM, which includes a pickup roller for sequentially picking up and feeding stacked media through a friction member provided on a portion of the outer periphery of the pickup roller, a feed roller for feeding the picked-up and fed media toward a transfer path through a friction member provided on a portion of the outer periphery of the feed roller while rotating with the same phase as the pickup roller, and a medium separation unit for separating a following medium, which is simultaneously fed with a preceding medium fed to the feed roller while being in close contact with the bottom thereof, from the preceding medium through a separation belt, so as to pick up and feed media through a partial roller structure partially having a friction member and simultaneously perform the separation of the media through the medium separation unit of the separation belt structure, whereby it is possible to effectively separate and feed the picked-up and fed media sheet by sheet by the separation belt structure and thereby effectively prevent the problem that as media are picked up and fed using a feed belt of a belt structure in a belt-type medium separation device according to a prior art, a skew occurring in a preceding medium has influence on even a following medium, and therefore, the skew continuously occurs in media fed by the feed belt.

2. Description of the Prior Art

In general, an ATM is an automated machine which can assist basic financial services such as deposit or withdrawal without any bank clerk regardless of time and place in relation to financial services. The ATM is configured to enable a customer to directly perform financial transactions such as deposit or withdrawal of bills and checks using a medium such as a card or passbook.

For financial transactions with a customer, in a deposit transaction, the ATM receives bills or checks through a deposit/withdrawal unit and separates and transfers the received bills or checks sheet by sheet and stacks them in a temporary storage unit. Then, when the deposit transaction is established, the ATM transfers the stacked bills or checks to a cassette to be stacked therein. In a withdrawal transaction, the ATM separates and transfers bills or checks stacked in the cassette sheet by sheet to the deposit/withdrawal unit to be discharged therethrough.

In the ATM, the deposit/withdrawal unit, the temporary storage unit, and the cassette, in which media (bills or checks) are stacked, are provided with a medium separation device for separating and transferring the stacked media (bills or checks) sheet by sheet.

FIGS. 1 and 2 are views showing a medium separation device of an ATM according to a prior art.

As shown in FIG. 1 (*a*), the medium separation device according to the prior art includes a pickup roller 21 in close contact with stacked media 10 to pick up a medium 10, a feed roller 22 for feeding the medium 10 picked up by the pickup roller 21 in a medium feeding direction, and a separation roller 23 disposed opposite to the feed roller 22 with the media interposed therebetween to separate another medium simultaneously fed while being in close contact with the bottom of the medium 10 fed by the feed roller 22.

In the medium separation device according to the prior art configured as described above, the pickup roller 21 sequentially picks up stacked media 10 and feeds them to the feed roller 22. In the process in which the feed roller 22 feeds a medium 10, the separation roller 23 which stops or rotates in the opposite direction to the feed roller 22 separates another medium 10 simultaneously fed while being in close contact with the bottom of the fed medium 10, whereby the media 10 is fed by the feed roller 22 sheet by sheet.

However, the medium separation device according to the prior art has the problem that when a medium 10 having a folded leading end is picked up and fed as shown in FIG. 1 (*b*), there frequently occurs a case where the leading end of the medium 10 is rolled in the process in which the medium 10 passes through the separation roller 23 and therefore an error occurs in the media transfer.

Accordingly, a belt-type medium separation device capable of feeding even a medium having a folded leading end without any error through a feed belt and a separation belt has been disclosed in U.S. Patent Application Publication No. 2011-0101598 as a technique for preventing the aforementioned problem.

That is, the belt-type medium separation device adjusts the rotation of the feed belt and the separation belt with a difference in friction coefficient between the feed belt and the separation belt. Thus, the media stacked through the rotation of the feed belt are sequentially picked up and fed toward a transfer path, and the separation belt provided opposite to the feed belt separates another medium fed while being in close contact with the fed medium. Further, as the medium separation device is configured to have the belt structure, it is possible to prevent the error that a medium having a folded leading end is rolled even when the medium is picked up and fed, thereby effectively feeding the media.

Namely, according to the belt-type medium separation device configured as described above, as shown in FIG. 2, in the process of picking up and feeding a medium by a feed belt 31, a following medium 12 in close contact with the bottom of a picked-up preceding medium 11 is separated from the preceding medium 11 due to a difference in friction coefficient between the feed belt 31 and a separation belt 32.

However, the belt-type medium separation device configured as described above has a problem in that when a skew occurs in a preceding medium in the process of picking up and feeding the medium by the feed belt, the skew continuously occurs even in a following medium fed along the preceding medium due to the belt structure.

That is, in case of the belt-type medium separation device according to the prior art, as the medium is picked up and fed through a long feed belt, a surface of a following medium is brought into contact with the belt at the rear of a rear end of a preceding medium in the process of feeding the preceding medium. Accordingly, when the skew occurs in the preceding medium, the portion of the following medium that is in contact with the belt at the rear of the rear end of the preceding medium, is not even, and therefore, the skew continuously occurs in the following medium.

Prior Art Documents

Patent Document 1

U.S. Patent Application Publication No. 2011-0101598 published May 5, 2011, entitled "METHOD OF OPERATING A DOCUMENT FEEDING MECHANISM TO REDUCE CHANCE OF A DOCUMENT JAM CONDITION AND AN APPARATUS THEREFOR"

SUMMARY OF THE INVENTION

Accordingly, the present invention is conceived to solve the aforementioned problems in the prior art. An object of the present invention is to provide a medium separation device of an ATM, which includes a pickup roller for sequentially picking up and feeding stacked media through a friction member provided on a portion of the outer periphery of the pickup roller, a feed roller for feeding the picked-up and fed media toward a transfer path through a friction member provided on a portion of the outer periphery of the feed roller while rotating with the same phase as the pickup roller, and a medium separation unit for separating a following medium, which is simultaneously fed with a preceding medium fed to the feed roller while being in close contact with the bottom thereof, from the preceding medium through a separation belt, so as to pick up and feed media through a partial roller structure partially having a friction member and simultaneously perform the separation of the media through the medium separation unit of the separation belt structure, whereby it is possible to effectively separate and feed the picked-up and fed media sheet by sheet by the separation belt structure and thereby effectively prevent the problem that as media are picked up and fed using a feed belt of a belt structure in a belt-type medium separation device according to a prior art, a skew occurring in a preceding medium has influence on even a following medium, and therefore, the skew continuously occurs in media fed by the feed belt.

According to an aspect of the present invention for achieving the objects, there is provided a medium separation device of an ATM, which separates stacked media sheet by sheet and feeds them toward a transfer path. The medium separation device includes a pickup roller disposed above the stacked media, the pickup roller having a first friction member provided to protrude from a portion of the outer periphery of a roller body so as to be contacted with the stacked media, the pickup roller sequentially picking up and feeding the stacked media by the first friction member according to the rotation of the roller body; a feed roller disposed to be spaced apart from the pickup roller in a medium feeding direction, the feed roller having a second friction member provided on a portion of the outer periphery of a roller body so as to be contacted with the fed media, the feed roller feeding the picked-up and fed media toward a transfer path through the second friction member while rotating with the same phase with the pickup roller; and a medium separation unit disposed below the feed roller, the medium separation unit having a plurality of separation rollers and a separation belt wound around the separation rollers, the medium separation unit separating a following medium, which is simultaneously fed while being in close contact with a preceding medium fed by the pickup roller and the feed roller, from the preceding medium through the friction of the separation belt.

The medium separation device of the ATM according to the present invention includes a pickup roller and a feed roller, each having a friction member provided on a portion of the outer periphery of a roller body, and thus, is configured to pick up and feed stacked media by the friction member provided in each roller and perform the separation of the overlapped and fed media using a medium separation unit of a separation belt structure. With this configuration, it is possible to effectively separate and feed the picked-up and fed media sheet by sheet by the separation belt structure and thereby effectively prevent the problem that as media are picked up and fed using a feed belt of a belt structure in a belt-type medium separation device according to a prior art, a skew occurring in a preceding medium has influence on even a following medium, and therefore, the skew continuously occurs in media fed by the feed belt.

Further, there are provided a plurality of medium separation units of a belt structure for separating media, so that in the process in which a medium enters a gap between the feed roller and the separation belt of each medium separation unit and a following medium simultaneously fed while being in close contact with the preceding medium is separated from the preceding medium by the separation belt, the following medium in close contact with the preceding medium is separated by the separation belts. Hence, even when contact points between the following medium and the separation belts are partially slightly distorted, the following medium can be stably separated without the occurrence of any skew in the following medium due to the distortion.

Furthermore, even when mixed media (such as bills and checks mixed together) which are different in thickness are separated, the separation can be performed without being influenced by the thickness of each medium, thereby improving medium separation efficiency.

DETAILED DESCRIPTION OF THE EXEMPLARY EMBODIMENTS

Hereinafter, an exemplary embodiment of the present invention will be described in detail with reference to the accompanying drawings. The present invention is not limited to the following embodiment without departing from the spirits of the invention.

In general, a medium separation device provided in an ATM is provided at a deposit/withdrawal unit and a temporary storage unit, in which media (bills or checks) put by customers are stacked, a cassette in which media for transactions are accommodated, or the like in the ATM, to separate the stacked media sheet by sheet.

Figure 1A:
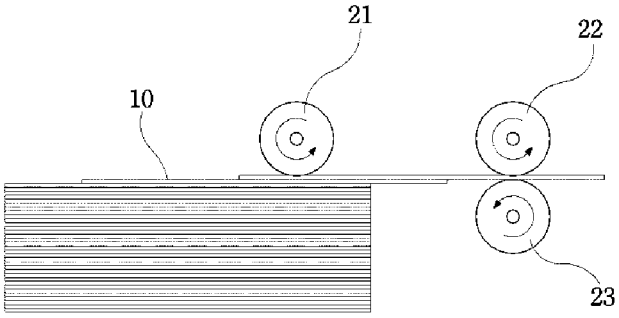
FIG. 1(a) PRIOR ART
FIGS. 1(*a*), 1(*b*) and 2 are views showing a medium separation device of an ATM according to a prior art.
Figure 1B:
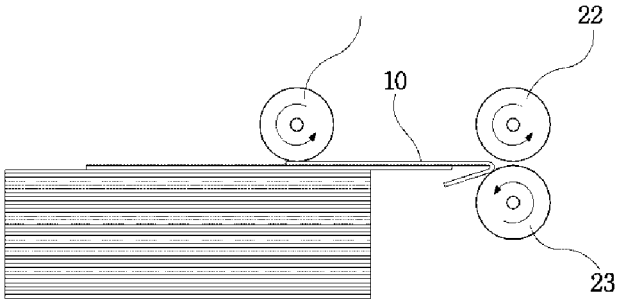
FIG. 1(b) PRIOR ART
Figure 2:
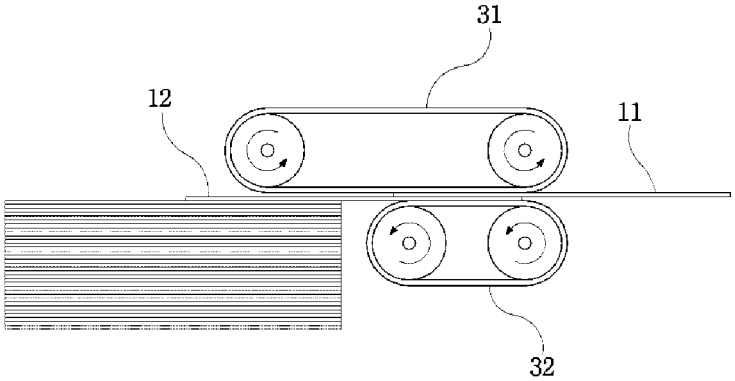
FIG. 2 PRIOR ART
Figure 3:
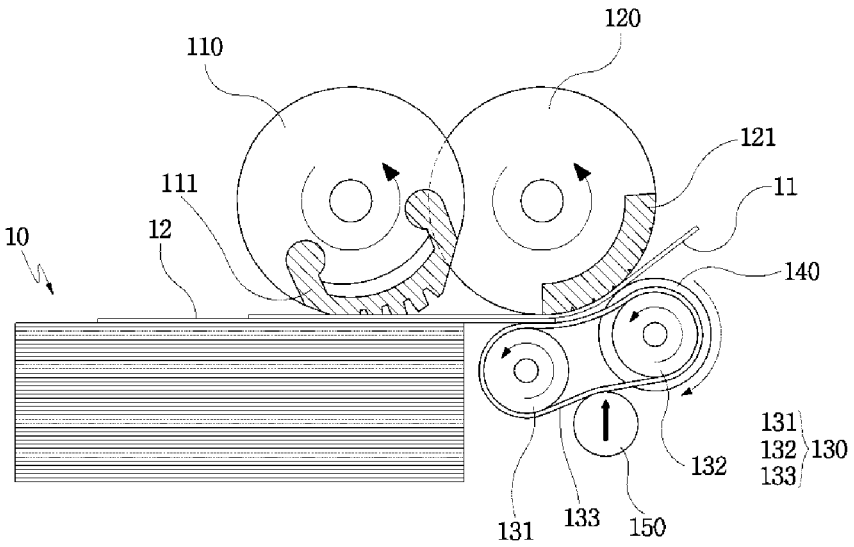
FIG. 3 is a side view showing a schematic configuration of a medium separation device of an ATM according to an embodiment of the present invention.
Figure 4:
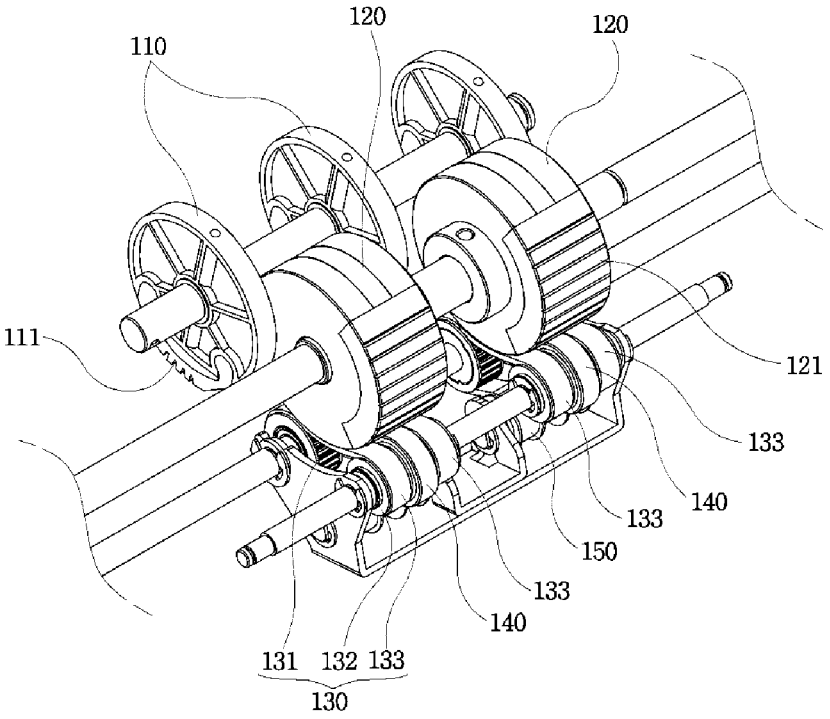
FIG. 4 is a perspective view showing an entire structure of the medium separation device of the ATM according to the embodiment of the present invention.

FIG. 3 is a side view showing a schematic configuration of a medium separation device of an ATM according to an embodiment of the present invention, and FIG. 4 is a perspective view showing an entire structure of the medium separation device of the ATM according to the embodiment of the present invention.

As shown in FIGS. 3 and 4, the medium separation device of the ATM according to the embodiment of the present invention includes a pickup roller 110 disposed above the stacked media 10, the pickup roller 110 having a first friction member 111 provided to protrude from a portion of the outer periphery of a roller body so as to be contacted with the stacked media 10, the pickup roller 110 sequentially picking up and feeding the stacked media 10 through the first friction member 111 according to the rotation of the roller body; a feed roller 120 disposed to be spaced apart from the pickup roller 110 in a medium feeding direction, the feed roller 120 having a second friction member 121 provided on a portion of the outer periphery of a roller body so as to be contacted with the fed media 10, the feed roller 120 feeding the picked-up and fed media 10 toward a transfer path through the second friction member 121 while rotating with the same phase with the pickup roller 110; a medium separation unit 130 disposed below the feed roller 120, the medium separation unit 130 having a plurality of separation rollers 131 and 132 and a separation belt 133 wound around the separation rollers 131 and 132, the medium separation unit 130 separating a following medium 12, which is simultaneously fed while being in close contact with a preceding medium 11 fed by the pickup roller 110 and the feed roller 120, from the preceding medium 11 through the friction of the separation belt 133; and a pinch roller 140 for transferring the media 10 passing between the feed roller 120 and the medium separation unit 130 onto the transfer path.

That is, the medium separation device according to the present invention configured as described above includes the pickup roller for sequentially picking up and feeding stacked media through the friction member provided on the portion of the outer periphery of the pickup roller, the feed roller for feeding the picked-up and fed media toward the transfer path through the friction member provided on a portion of the outer periphery of the feed roller while rotating with the same phase as the pickup roller, and the medium separation unit for separating a following medium, which is simultaneously fed with a preceding medium fed to the feed roller while being in close contact with the bottom thereof, from the preceding medium through the separation belt, so as to pick up and feed media sheet by sheet through the partial roller structure partially having the friction member and simultaneously perform the separation of the media through the medium separation unit of the separation belt structure, whereby it is possible to effectively separate and feed the picked-up and fed media sheet by sheet by the separation belt structure and allow media to be picked up sheet by sheet through the pickup roller of the partial roller structure. With this configuration, there is an advantage to effectively prevent the problem that as media are picked up and fed using the feed belt of the belt structure in the belt-type medium separation device according to the prior art, a skew occurring in a preceding medium has influence on even a following medium, and therefore, the skew continuously occurs in media fed by the feed belt.

Hereinafter, the configuration of the medium separation device of the ATM according to the embodiment of the present invention will be described in detail with reference to FIGS. 3 and 4. The pickup roller 110 is disposed above the stacked media and serves to pick up and feed the stacked media 10 sequentially from a medium 10 disposed at the uppermost portion.

The pickup roller 110 has the first friction member 111 provided to protrude from the portion of the outer periphery of the roller body so as to be contacted with the media 10. Thus, if the pickup roller 110 is rotated in the medium feeding direction by a first driving motor (not shown), the stacked media 10 are picked up and fed toward the feed roller 120 sequentially from the medium disposed at the uppermost portion while the first friction member 111 provided on the portion of the outer periphery of the roller body in the pickup roller 110 rotates around the roller body.

That is, the first friction member 111 provided to protrude from the pickup roller 110 is provided on the portion of the outer periphery of the roller body so as to pick up and feed one of the stacked media 10 toward the feed roller 120 whenever the pickup roller 110 rotates once. Here, the outer periphery of the pickup roller 110 is formed to have a circumferential length corresponding to that of the stacked media 10. Accordingly, the first friction member 111 of the pickup roller 110 allows one of the stacked media 10 to be picked up and fed whenever the pickup roller 110 rotates once.

In order to effectively feed the picked-up medium 10, the outer periphery of the first friction member 111 is preferably formed to have a circumferential length equal to or greater than the length from a medium pickup start point of the first friction member 111 to a medium contact point of the feed roller 120.

At least one pickup roller 110 configured as described above may be installed on the same shaft, so that the pickup roller 110 picks up and feeds the medium 10 by the driving of the first driving motor (not shown). In this embodiment, as shown in FIG. 4, three pickup rollers 110 are installed on the same shaft to be spaced apart from one another, so that both sides and center of the top of the medium 10 are simultaneously picked up and fed by the three pickup rollers 110.

The feed roller 120 is disposed to be spaced apart from the pickup roller 110 in the medium feeding direction and severs to feed the medium 10 picked up and fed by the pickup roller 110 toward the transfer path.

Here, the feed roller 120 is formed to have the same diameter as the pickup roller 110 and has a second friction member 121 provided on a portion of the outer periphery of the roller body so as to be contacted with the medium 10. The feed roller 120 is rotated with the same phase as the pickup roller 110 by the first driving motor (not shown).

With this configuration, if the feed roller 120 is rotated by the first driving motor (not shown), the medium 10 picked up and fed by the pickup roller 110 is fed toward the transfer path as the second friction member 121 provided on the portion of the outer periphery of the roller body in the feed roller 120 rotates around the roller body.

That is, the feed roller 120 is disposed to be spaced apart from the pickup roller 110 at a position close to the stacked medium and then rotates with the same phase as the pickup roller 110. Accordingly, the moment the first friction member 111 of the pickup roller 110 picks up and feeds the stacked media 10 according to the rotation of the pickup roller 110, the leading end of the fed medium 10 is brought into contact with the feed roller 120. In this instance, the second friction member 121 of the feed roller 120, which rotates with the same phase as the first friction member 111 of the pickup roller 110, feeds the medium 10 toward the transfer path.

At least one feed roller 120 configured as described above may be installed on the same shaft, so that the feed roller 120 feeds the medium 10 picked up and fed by the pickup roller 110 by the driving of the first driving motor (not shown). In this embodiment, as shown in FIG. 4, a pair of the feed rollers 120 are installed on the same shaft. The respective feed rollers 120 are arranged between the three pickup rollers 110 to be spaced apart from the three pickup rollers 110 at a predetermined distance in the medium feeding direction.

Here, the feed roller 120 is formed to have the outer periphery relatively wider than that of the pickup roller 110 so that the feed roller 120 can be correspondingly in contact with the separation belt 133 and the pinch roller 140, which will be described later.

As described above, the medium separation device according to the present invention includes the pickup roller 110 and the feed roller 120, partially having the respective friction members 111 and 121, to pick up and feed the media 10 sheet by sheet through the first friction member 111 in the rotation of the pickup roller 110 and feed the fed media 10 toward the transfer path through the second friction member 121 of the feed roller 120 rotated with the same phase as the pickup roller 110, thereby effectively preventing the problem that as media are picked up and fed using the feed belt of the belt structure in the belt-type medium separation device according to the prior art, a skew occurring in a preceding medium has influence on even a following medium, and therefore, the skew continuously occurs in the media fed by the feed belt.

That is, in the belt-type medium separation device according to the prior art, as media are picked up and fed through a long feed belt, a surface of a following medium is contacted with the belt at the rear of a rear end of a preceding medium in the process of feeding the preceding medium. Accordingly, when a skew occurs in the preceding medium, the portion of the following medium, which is contacted with the belt at the rear of the rear end of the preceding medium, is not even, and therefore, the skew continuously occurs in the following medium. The present invention solves this problem by using the pickup roller and the feed roller each having the partial roller structure described above.

Meanwhile, the medium separation unit 130 is disposed below the feed roller 120 and has a plurality of separation rollers 131 and 132 and a separation belt 133 wound around the separation rollers 131 and 132. Thus, the medium separation unit 130 serves to separate a following medium 12, which is simultaneously fed while being in close contact with a preceding medium 11 fed by the pickup roller 110 and the feed roller 120, from the preceding medium 11 through the friction of the separation belt 133.

That is, as shown in FIG. 3, the medium separation unit 130 includes the first separation roller 131 disposed vertically opposite to the feed roller 120, the second separation roller 132 disposed to be spaced apart from the first separation roller 131 toward the transfer path, and the separation belt 133 wound around the first and second separation rollers 131 and 132 to separate the following medium 12, which is simultaneously fed while being in close contact with the preceding medium 11 fed by the pickup roller 110 and the feed roller 120, from the preceding medium 11.

In the medium separation unit 130 configured as described above, the first and second separation rollers 131 and 132 are connected to a second driving motor (not shown), so that the first and second separation rollers 131 and 132 can be stopped or rotated in the opposite direction to the medium feeding direction. When the first and second separation rollers 131 and 132 are rotated in the opposite direction to the medium feeding direction, the separation belt 133 wound around the first and second separation rollers 131 and 132 is rotated in the opposite direction to the medium feeding direction along the first and second separation rollers 131 and 132.

With this configuration, the medium separation unit 130 is configured such that the separation belt 133 is rotated in the opposite direction to the medium feeding direction by the second driving motor (not shown), and a top surface of the separation belt 133 is disposed opposite to a lower portion of the feed roller 120. Thus, in the process in which the media 10 picked up and fed by the pickup roller 110 pass between the feed roller 120 and the separation belt 133 and are fed toward the transfer path, the separation belt 133 transmits the frictional force to the bottom of the fed medium 11 or the bottom of the following medium 12 simultaneously fed while being in close contact with the bottom of the fed medium 11.

In this instance, the friction coefficient of the second friction member 121 provided in the feed roller 120 is set greater than that of the separation belt 133. Accordingly, the medium fed by the second friction member 121 can overcome the friction with the separation belt 133 to pass between the feed roller 120 and the separation belt 133 and be fed.

On the other hand, the following medium 12, which is simultaneously fed while being in close contact with the bottom of the preceding medium 11 fed by the feed roller 120, can be separated from the preceding medium 11 by the frictional force between the following medium 12 and the separation belt 133 in close contact with the bottom of the following medium 12.

A plurality of the medium separation units 130 configured as described above may be provided to perform the stable medium separation and disposed below the feed roller 120.

In this embodiment, as shown in FIG. 4, four medium separation units 130 are disposed below the pair of feed rollers 120, wherein as each pair of the medium separation units 130 are disposed below both sides of each feed roller 120, top surfaces of the pair of separation belts 133 are contacted with a lower outer periphery of each feed roller 120.

Accordingly, in the process in which the medium 11 enters the gap between the feed roller 120 and the separation belt 133 of the medium separation unit 130 and the following medium 12 simultaneously fed while being in close contact with the preceding medium 11 is separated from the preceding medium 11 by the separation belt 133, the following medium 12 in close contact with the preceding medium 11 is separated from the preceding medium 11 by the two pairs of separation belts 133 respectively disposed at left and right sides on the medium transfer path. Hence, even when a contact point between the following medium 12 and the separation belt 133 is partially slightly distorted, the following medium 12 can be stably separated without the occurrence of any skew in the following medium 12 due to the distortion.

Further, even when mixed media (such as bills and checks mixed together) which are different in thickness are separated, the separation can be performed without being influenced by the thickness of each medium, thereby improving medium separation efficiency.

As shown in FIGS. 3 and 4, each separation belt 133 is provided with a tension adjusting unit 150 for adjusting the tension of the separation belt 133, so that the tensions of the separation belts 133 can be equally adjusted. Accordingly, it is possible to prevent a hindrance from occurring in the medium separation due to looseness of the separation belt 133, or the like.

In the configuration of FIGS. 3 and 4 described above, the separation belt 133 of the medium separation unit 130 is configured to rotate in the opposite direction to the medium feeding direction, so that the medium separation unit 130 separates the following medium 12, which is simultaneously fed while being in close contact with the preceding medium 11 fed by the pickup roller 110 and the feed roller 120, from the preceding medium 11 through the frictional force of the separation belt 133. However, the separation belt 133 of the medium separation belt 130 may be configured to maintain a stop state without rotation. In this instant, it will be apparent that the medium separation unit 130 may separate the following medium 12, which is simultaneously fed while being in close contact with the preceding medium 11, from a preceding medium 11 through the frictional force of the separation belt 133.

Meanwhile, the pinch roller 140 serves to feed and transfer the media 10, which pass between the feed roller 120 and the medium separation unit 130, onto the transfer path.

The pinch roller 140 is disposed to be in contact with the feed roller 120 at the rear end of the medium separation device. The pinch roller 140 is connected to the first driving motor (not shown) to be rotated according to the driving of the first driving motor (not shown). The pinch roller 140 feeds the media 10, which are separated sheet by sheet between the feed roller 120 and the medium separation unit 130 and fed by the feed roller 120, toward transfer rollers (not shown) on the transfer path.

That is, the pinch roller 140 is in contact with the feed roller 120 to feed the media, which pass through the medium separation unit 130 and are fed sheet by sheet, toward the transfer rollers (not shown) on the transfer path.

As shown in FIGS. 3 and 4, in this embodiment, a pair of pinch rollers 140 are provided on the same shaft as the second separation roller 132 of the medium separation unit 130.

That is, the pinch rollers 140 are coaxially provided between a pair of the second separation rollers 132 each having the separation belt 133 wound therearound below the feed roller 120, so that the pinch rollers 140 are rotated according to the shaft rotation driven by the first driving motor (not shown) and accordingly feed the media 10 by cooperating with the pair of feed rollers 120 in contact therewith. In this instance, the second separation roller 132 provided on the same shaft is coupled to the shaft by bearings, so that the second separation roller 132 is idled in the shaft rotation driven by the first driving motor (not shown).

In other words, the second separation roller 132 is provided on the same shaft as the pinch roller 140 but driven separately from the pinch roller 140 because the second separation roller 132 is connected to the shaft by the bearings. Therefore, when the first separation roller 131 is rotated by the second driving motor (not shown), the second separation roller 132 receives the power transmitted by the separation belt 133 to rotate together with the first separation roller 131.

Meanwhile, in the above description, the first driving motor (not shown) is connected to the shaft, on which the pickup roller 110, the feed roller 120, and the pinch roller 140 are provided, through a power transmission unit (not shown) such as gears, pulleys, and belts. Thus, the first driving motor (not shown) drives the pickup roller 110, the feed roller 120, and the pinch roller 140 to feed the media. The second driving motor (not shown) is connected to the shaft, on which the first separation roller 131 of the medium separation unit 130 is provided, to drive the separation belt 133 of the medium separation unit 130.

Hereinafter, a process of operating the medium separation device of the ATM according to the embodiment of the present invention will be described.

Figure 5:
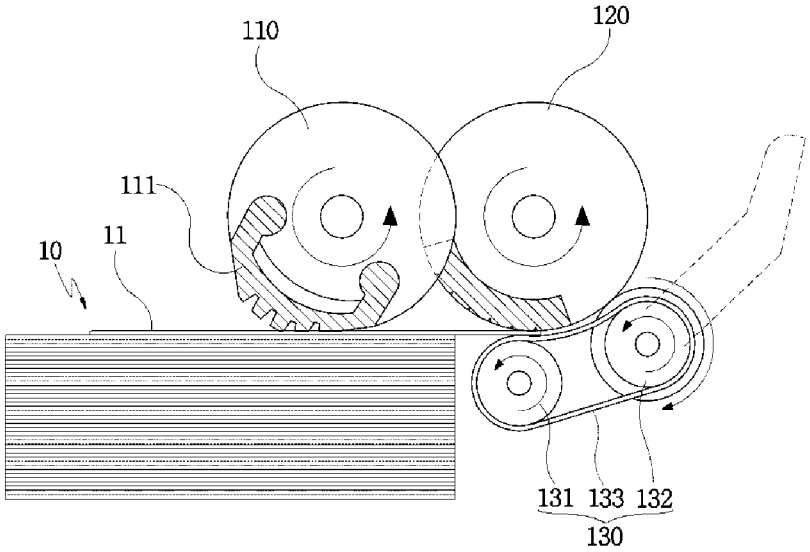
FIGS. 5 to 7 are views showing a process of separating media through the medium separation device of the ATM according to the embodiment of the present invention.
Figure 6:
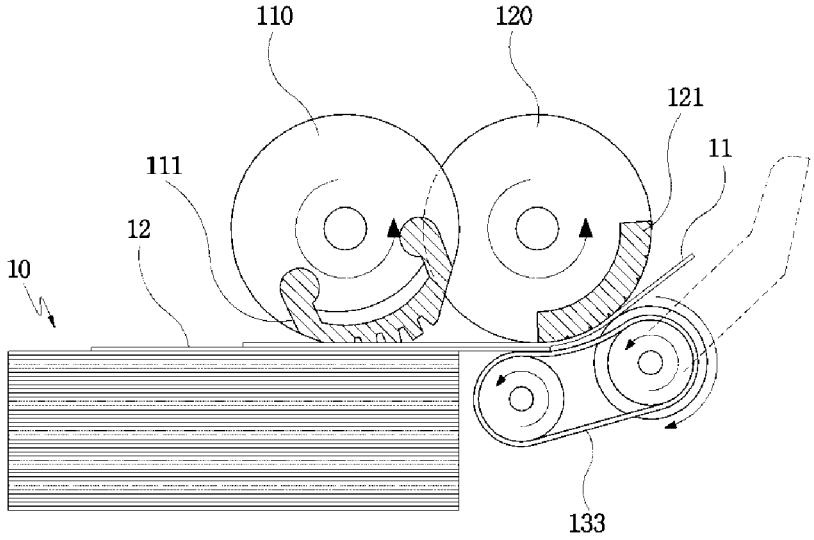
Figure 7:
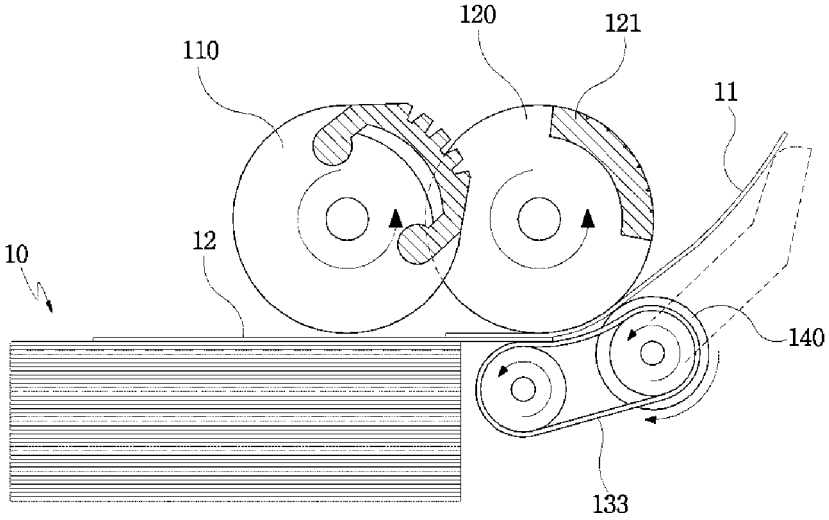

FIGS. 5 to 7 are views showing a process of separating media through the medium separation device of the ATM according to the embodiment of the present invention.

As shown in FIG. 5, in order to separate the stacked media 10 sheet by sheet and feed them toward the transfer path, the pickup roller 110 is first rotated, so that the medium 11 disposed at the uppermost portion in the stacked media 10 is picked up and fed by the first friction member 111 provided on the portion of the outer periphery of the roller body. In this process, the medium 11 enters the gap between the feed roller 120 disposed to be spaced apart from the pickup roller 110 and the separation belt 133 of the medium separation unit 130.

In this instance, as shown in FIG. 6, the feed roller 120 is rotated with the same phase with the pickup roller 110. Accordingly, the second friction member 121 of the feed roller 120 feeds the medium 11 toward the transfer path while rotating with the same phase as the first friction member 111 of the pickup roller 110.

In this process, the following medium 12 disposed next to the medium 11 among the stacked media 10 is brought into close contact with the bottom of the preceding medium 11 fed by the pickup roller 110 and the feed roller 120 by the frictional force between the media, and the media 11 and 12 are simultaneously fed in a state in which they partially overlaps with each other.

Then, in the process in which the preceding medium 11 fed by the pickup roller 110 and the feed roller 120 passes between the feed roller 120 and the separation belt 133, the preceding medium 11 is fed toward the transfer path by the second friction member 121 of the feed roller 120 which has a friction coefficient relatively greater than that of the separation belt 133. In this instance, while being in close contact with the bottom of the preceding medium 11 and partially overlapping therewith, the following medium 12 fed along with the preceding medium 11 has the friction applied thereto by the separation belt 133 while entering the gap between the feed roller 120 and the separation belt 133. Thus, the following medium 12 is separated from the preceding medium 11.

Thereafter, as shown in FIG. 7, the preceding medium 11 fed by the second friction member 121 of the feed roller 120 passes between the feed roller 120 and the pinch roller 140 and is fed onto the transfer path by the driving of the pinch roller 140 to be transferred along the transfer path through the transfer rollers (not shown) provided on the transfer path. In the next rotation of the feed roller 120, the following medium 12 separated from the preceding medium 11 by the separation belt 133 is fed by the second friction member 121, passes between the feed roller 120 and the pinch roller 140, and is fed onto the transfer path. Thus, the preceding medium 11 and the following medium 12 are separated from each other at a predetermined distance and then transferred along the transfer path.

As described above, the medium separation device of the ATM according to the present invention includes a pickup roller and a feed roller, each having a friction member provided on a portion of the outer periphery of a roller body, and thus, is configured to pick up and feed stacked media by the friction member provided in each roller and perform the separation of the overlapped and fed media using a medium separation unit of a separation belt structure. With this configuration, it is possible to effectively separate and feed the picked-up and fed media sheet by sheet by the separation belt structure and thereby effectively prevent the problem that as media are picked up and fed using a feed belt of a belt structure in a belt-type medium separation device according to a prior art, a skew occurring in a preceding medium has influence on even a following medium, and therefore, the skew continuously occurs in media fed by the feed belt.

Further, there are provided a plurality of medium separation units of a belt structure for separating media, so that in the process in which a medium enters a gap between the feed roller and the separation belt of each medium separation unit and a following medium simultaneously fed while being in close contact with the preceding medium is separated from the preceding medium by the separation belt, the following medium in close contact with the preceding medium is separated by the separation belts. Hence, even when contact points between the following medium and the separation belts are partially slightly distorted, the following medium can be stably separated without the occurrence of any skew in the following medium due to the distortion.

Furthermore, even when mixed media (such as bills and checks mixed together) which are different in thickness are separated, the separation can be performed without being influenced by the thickness of each medium, thereby improving medium separation efficiency.

What is claimed is:

1. A medium separation device of an automated teller machine (ATM), which separates stacked media sheet by sheet and feeds them toward a transfer path, the medium separation device comprising:

three pickup rollers disposed above the stacked media, each of the pickup rollers having a first friction member protruding from a portion of the outer periphery of a roller body of each of the pickup rollers so as to be contacted with the stacked media, each of the pickup rollers sequentially picking up and feeding the stacked media by the first friction member according to the rotation of the roller body, the three pickup rollers spaced apart on a same shaft along a direction perpendicular to a medium feeding direction in which the stacked media are fed;

two feed rollers spaced apart from the pickup rollers in the medium feeding direction on a same shaft, each of the feed rollers having a second friction member provided on a portion of the outer periphery of a roller body of each feed roller so as to be contacted with media picked up and fed by the pickup rollers, each of the feed rollers feeding the picked-up and fed media toward the transfer path through the second friction member while rotating with a same phase as the pickup rollers, each of the feed rollers inserted between the pickup rollers; and four medium separation units disposed below the feed rollers, each of the medium separation units having a plurality of separation rollers and a separation belt wound around the separation rollers, the medium separation unit separating a following medium, which is simultaneously fed while being in close contact with a preceding medium fed by the pickup roller and the feed roller, from the preceding medium through the friction of the separation belt, each pair of the medium separation units is disposed below both sides of each of the feed rollers.

2. The medium separation device of claim 1, further comprising a pinch roller for transferring the media passing between the feed rollers and the medium separation units onto the transfer path.

3. The medium separation device of claim 1, wherein the outer periphery of the roller body of each of the pickup rollers is formed to have a circumferential length corresponding to that of the media, so that the first friction member allows one of the stacked media to be picked up and fed whenever the pickup roller rotates once.

4. The medium separation device of claim 3, wherein the outer periphery of the first friction member is formed to have a circumferential length equal to or greater than that from a medium pickup start point of the first friction member to a medium contact point of each of the feed rollers.

5. The medium separation device of claim 1, wherein each of the feed rollers is formed to have the same diameter as each of the pickup rollers.

6. The medium separation device of claim 1, wherein the second friction member is configured to have a friction coefficient relatively greater than that of the separation belt.

7. The medium separation device of claim 1, wherein each of the medium separation units includes:

a first separation roller disposed vertically opposite to the feed roller;

a second separation roller disposed to be spaced apart from the first separation roller toward the transfer path; and a separation belt wound around the first and second separation rollers to separate the following medium, which is simultaneously fed while being in close contact with the preceding medium fed by the pickup roller and the feed roller, from the preceding medium.

8. The medium separation device of claim 7, wherein the separation belt is provided with a tension adjusting unit for adjusting the tension of the separation belt.

* * * * *